United States Patent [19]

Vanek

[11] 4,085,603

[45] Apr. 25, 1978

[54] METHOD OF MAKING V-SHAPED MAGNETIC CIRCUIT ELEMENTS

[76] Inventor: Jaroslav Vanek, 35, rue des Cascades, 75020 Paris, France

[21] Appl. No.: 767,225

[22] Filed: Feb. 9, 1977

Related U.S. Application Data

[62] Division of Ser. No. 577,014, May 13, 1975, abandoned.

[30] Foreign Application Priority Data

| | | |
|---|---|---|
| May 21, 1974 | France | 74 17646 |
| Oct. 18, 1974 | France | 74 35225 |
| Mar. 27, 1975 | France | 75 09707 |

[51] Int. Cl.[2] ..... B21D 31/00; H01F 3/04

[52] U.S. Cl. ..... 72/41; 29/605; 29/609; 72/367

[58] Field of Search ..... 29/605, 609; 72/41, 72/402, 367; 336/5, 212, 213, 215

[56] References Cited

U.S. PATENT DOCUMENTS

| | | | |
|---|---|---|---|
| 2,260,398 | 10/1941 | Otte | 29/609 |
| 2,423,345 | 7/1947 | Rotors | 29/609 |
| 2,864,159 | 12/1958 | Doering et al. | 72/402 X |
| 3,195,081 | 7/1965 | Kunes | 336/213 |

FOREIGN PATENT DOCUMENTS

| | | | |
|---|---|---|---|
| 829,377 | 3/1960 | United Kingdom | 72/367 |
| 994,898 | 6/1965 | United Kingdom | 336/5 |

*Primary Examiner*—E. M. Combs
*Attorney, Agent, or Firm*—Cushman, Darby & Cushman

[57] ABSTRACT

The invention relates to star-shaped magnetic circuit elements. Such elements can be obtained by manufacturing a tore-shaped magnetic circuit element by winding a magnetic sheet strip around a pin. Then this tore-shaped element is pressed by converging equidistant pressing means. The obtained star is adapted to receive electrical coil bobbins on each of its legs and is accordingly adapted for constituting the core of a symmetrical star-shaped transformer.

7 Claims, 10 Drawing Figures

METHOD OF MAKING V-SHAPED MAGNETIC CIRCUIT ELEMENTS

This is a division of my copending application Ser. No. 577,014, filed May 13, 1975, which was abandoned.

BACKGROUND OF THE INVENTION

1. Field of the Invention

The present invention relates to elements of magnetic circuits having a star configuration and, more specifically, to their application to polyphase transformers.

2. Description of the Prior Art

Conventionally, the polyphase transformers, and more specifically the three-phase transformers, are of the E-type, that is with three core-columns in a same plan, or of the five columns type or of the shell-type.

Referring to conventional theoretical books on the polyphase transformers, (in particular the "Cours de Machines Electriques", C.N.A.M. Editions de M. Bellier or "Electrotechnique generale", Editions Scientifiques Riber, tome 3 of A. Busson), it will be appreciated that those three types of transformers have the drawback of a non-symmetrical magnetic circuit as the length of the frame to be crossed by the magnetic flux is not the same from a side column to the central column or to the other side column. Various means are used for palliating this dissymmetry; however, the magnetic circuit of those devices remains non-symmetrical and it is easy to measure that the no-load currents are not identical in the three phases and the power absorbed by each phase is different from the others. In the general purpose conventional books about polyphase transformers, it will be appreciated that there is generally an introductory paragraph wherein it is explained that a transformer having a star configuration would be ideal for obtaining a three-phase symmetrical transformer but that such a configuration cannot be practically achieved as it would cause the presence of gaps in the central part of the magnetic circuit forming the star, such gaps would be difficult to tighten and would cause important losses in the magnetic circuit.

SUMMARY OF THE INVENTION

A main object of the present invention is to provide a magnetic circuit element having a star configuration without any gap portion in the center of the star.

Another object of the present invention is to provide a manufacturing process of such a magnetic circuit element having a star configuration.

A further object of the present invention is to provide the application of such a magnetic circuit element having a star configuration into a polyphase transformer.

A yet further object to the present invention is to provide such a polyphase transformer on whih the bobbins carrying the electrical coils can be easily assembled.

In order to achieve those objects and others, the invention provides a magnetic circuit element having a star configuration in which the material constituting at least two adjacent half legs of two adjacent legs of the star is continous in the direction of the propagation of the magnetic flux. According to the invention, said star-shaped magnetic circuit element can be obtained by winding a strip of magnetic sheet in order to obtain a tore-shaped magnetic circuit, then forming this tore-shaped circuit by means of a pressure device radially operating towards the center of the tore on a plurality of regularly angularly spaced points. This "star" can also be obtained by assembling together magnetic elements having a V-shape, each of which constituting two adjacent half-legs of two adjacent legs. This star can also be obtained by means of magnetic bars, constituting each leg of the star, the central legs of which are pressed between two side plates made of magnetic material avoiding accordingly the end to end gaps of the prior art. In every case, each leg of the obtained star is shaped to receive one or more electrical bobbins.

Furthermore, the invention provides the use of this magnetic circuit element as a part of a polyphase electrical transformer or of a phase number transformer by arranging bobbins around each leg of the star, then by closing the magnetic circuit through tore-shaped yokes arranged on both sides of the star-shaped element, the external radius of those tore-shaped elements being substantially equal to the length of the star legs and those tore-shaped elements being tightened against the star-shaped element by suitable pressing means.

Accordingly, the invention provides an electrical transformer wherein a very good symmetry of the phases is obtained, this transformer being particularly simple to assemble as precoiled bobbins can be arranged on each of the star legs and then the tore-shaped yokes put on the legs and easily tightened. Those transformers present the advantage of having a greater power per unit weight than the one of the conventional three-phase transformers which are E-shaped, or provided with five columns, or shell-type. Moreover, due to the absence of end to end gap in the star, the no-load current, the magnetic material weight, the electrical material weight, can be reduced in transformers according to the present invention with respect to conventional transformers having the same power.

BRIEF DESCRIPTION OF THE DRAWINGS

Those objects, features and advantages together with others of the present invention will be explained in the following detailed description of various preferred embodiments, taken in relation with the attached drawings wherein.

DESCRIPTION OF THE PREFERRED EMBODIMENTS

A star-shaped magnetic circuit element will be called hereunder "star circuit" or simply "star". It will be further appreciated that in the hereunder description of preferred embodiments, only three-legs circuits will be disclosed. It is however clear for those skilled in the art that star circuits comprising any number of legs adapted to polyphase currents other than three-phase currents can be carried out according to the present invention.

Figure 1:
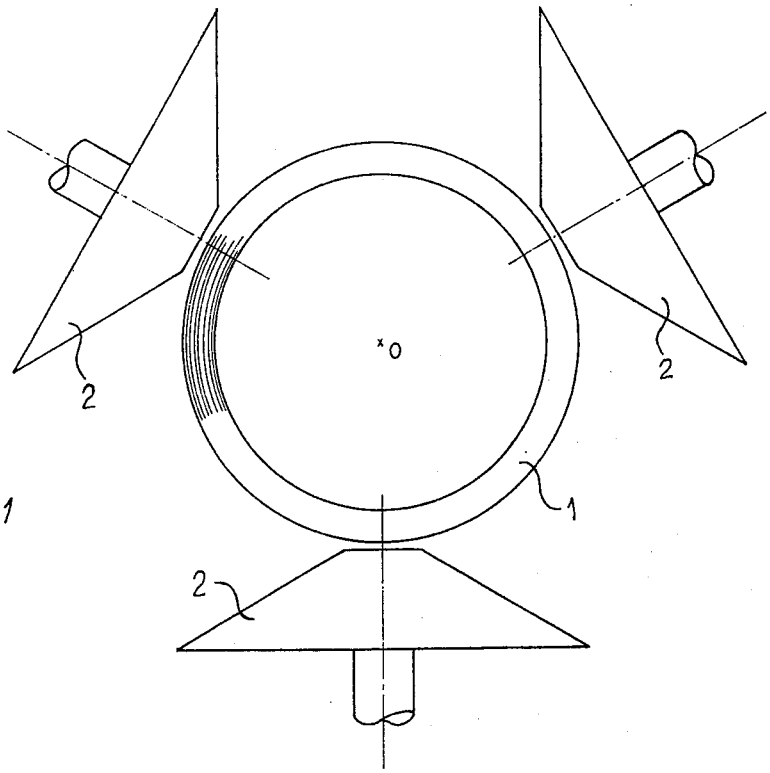
FIGS. 1 and 2 are schematical views explaining a manufacturing method of a magnetic circuit element having a star configuration according to the first embodiment of the invention.

FIG. 1 shows a tore-shaped magnetic circuit element positioned between three jaws 2. This tore-shaped element 1 is preferentially made by winding a strip of magnetic sheet around a spindle. Such tore-shaped elements are readily made by the magnetic circuit manufacturers, and machines for carrying out same are well known; accordingly, the use of such tore-shaped elements is preferentially disclosed in the present invention, although any other initial shape of the element 1 can be provided for example a polygonal shape. The three jaws 2 are a part of a pressing device adapted to push the jaws toward the point 0.

Figure 2:
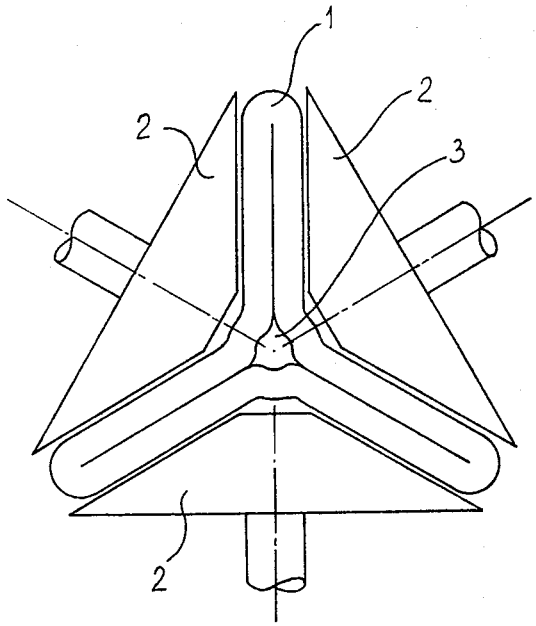

FIG. 2 shows the final step of this manufacturing process, the jaws 2 having been slightly tightened off. It will be noted that, further to the pressing step, the element 1 has taken a star-shape which is substantially complementary to the one of the jaws and, in particular, in the example shown, a clearance has been managed at the center of the star to eventually permit the passage of a securing means. The presence and the shape of this clearance are determined by the shape of the jaws, and, further, it can be provided to arrange, before the pressing step, a piece of given shape at the center of the tore-shaped element 1 for determining the shape of the clearance.

Once the star shown in FIG. 2 has been obtained, other conventional operations can be carried out on the magnetic circuit element, in particular, this star will be generally subject to a baking operation and will be possibly impregnated by a conventional method, such as a bath impregnation or an impregnation in a vacuum. Furthermore, it is possible to provide after the impregnation steps a surfacing or a grinding of predetermined parts of the star faces.

Figure 3:
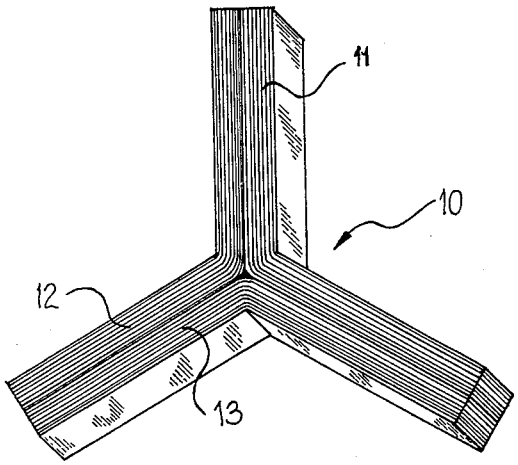
FIG. 3 shows a second embodiment of a star-shaped magnetic circuit according to the invention.

Referring to FIG. 3, a star circuit 10 comprises three stackings 11, 12 and 13 of magnetic sheets which have been cut and folded, each stacking forming two adjacent half-legs of the star. Each pair of adjacent half-legs 11, 12 and 13 can be formed either from a stacking of plane magnetic sheets which are then folded, or from a stacking of pre-folded magnetic sheets. It should also be noted that FIG. 3 is a schematic drawing and that in fact the ends of the star legs are not necessarily straight cut but that due to the folding and the stacking, there is a slight length shift between the ends of the successive magnetic sheets of the stacking. Then, the legs of the star are mechanically bound by any known means, such as heat shrinkable sheaths, clamps, holes and rivets. It will be accordingly noted that the star 10 shown in FIG. 3 is easier to manufacture than the star 1 shown in FIG. 2 in case the size of the star is great. However, in this case, it is necessary to provide additional mechanical means to assemble the star.

Figure 4A:
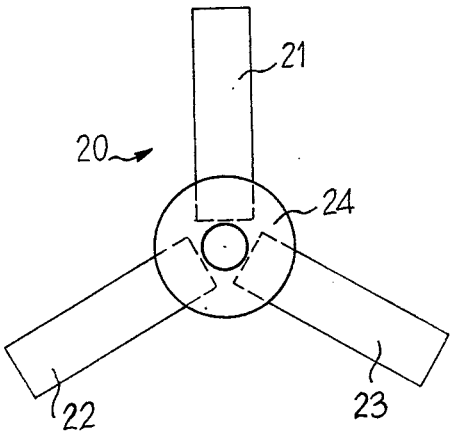
FIGS. 4A and 4B are respectively front view and left view of a third embodiment of a star shaped magnetic element according to the present invention.
Figure 4B:
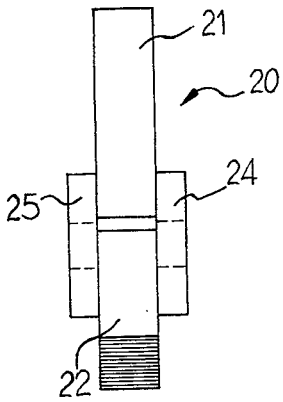

FIGS. 4A and 4B respectively show a front view and a left view of a third embodiment of the star according to the invention; A star 20 comprises three legs 21, 22 and 23. The continuity of the magnetic circuit at the center part of the star is obtained by the means of two de plates 24 and 25 provided with a central aperture for permitting their tightening against the central parts of the legs of the star, for example by means of screws and nuts and thereby providing a mechanical quality and the closing of the magnetic circuit. It will be apparent that this central fixation can be replaced by lateral fixation. The side plates provided with a central aperture will be advantageously made of a wound magnetic sheet. It will be noted that each of the legs 21, 22 and 23 can be either made of a stacking of sheets bound together by any known mechanical means (heatshrinkable sheaths, clamps, holes and rivets) or that each of the legs 21, 22 and 23 can be formed from a winding of tore-shaped magnetic circuits pressed between two plane surfaces. In this latter case it is unnecessary to provide mechanical securing means for the sheet stackings constituting each leg of the star.

Figure 5:
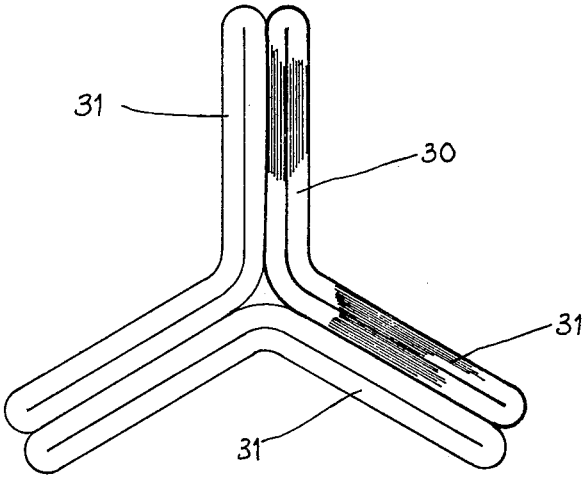
FIG. 5 shows a fourth embodiment of star-shaped magnetic circuit according to the invention.

In FIG. 5, a star circuit 30 comprises three individual V-shaped elements 31. Each V-shaped element is obtained from a tore-shaped magnetic circuit made of a magnetic sheet wound by any known means which is then flattened and V-shaped.

The simpler manufacturing way for making such a V-shaped element consists in flattening a magnetic tore on a press for obtaining a flat bar without any central slot. Then, this bar is folded by any known means. This very simple method presents a drawback which is, as one can see when examining one of these V-shaped elements, that the magnetic sheet length in the concave part of the element is smaller than the sheet length in the convex part of the element. Accordingly, during the folding operation, a sliding of the sheets should arise but this sliding is made difficult or prevented by the flattened areas at the end of the bars. Accordingly, defects or breakings can arise in the sheet. Such a process can be used only for very elementary circuits or for circuits obtained from sheet windings having a smaller number of turns.

Figure 6:
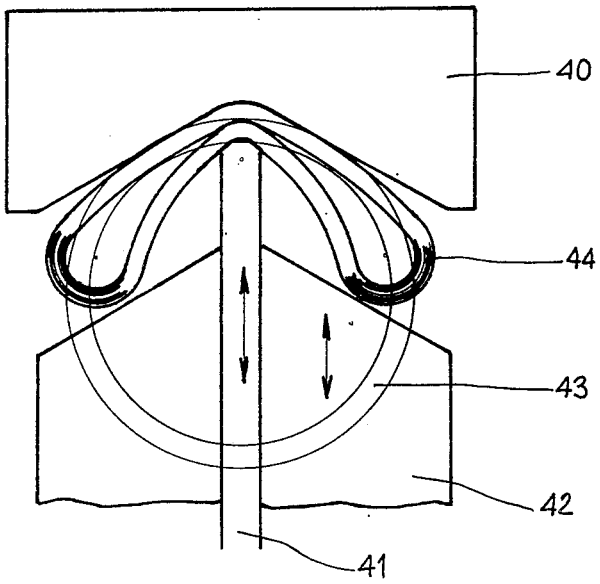
FIG. 6 shows a manufacturing method of a V-shaped element used in the star-shaped magnetic circuit according to FIG. 5.

FIG. 6 shows a preferred method for manufacturing the V-shaped element according to the invention. For permitting the magnetic sheets to slide with respect to one another, during the forming operation without strains (tensile or crushing stresses) which could have adverse effect on the crystalline structure of the magnetic sheets which are usually oriented sheets, it is necessary to avoid the formation of the flattened end at the end of the bar prior to the folding. In FIG. 6, the reference 40 indicates a V-shaped stamping die, the reference 41 a central punch, the reference 42 a surrounding punch, both punches being operated independently, the reference 43 the tore shaped element before the operation of the punches and the reference 44 the magnetic element formed during the manufacturing process after the operation of the first punch.

According to an implementation of the manufacturing method according to the invention, the tore 43 is positioned on the stamping die 40. The central punch operates alone in front of the central part of the V, the tore 43 takes substantially the pattern shown by the reference 44. Then, the surrounding punch 42 operates, thereby a V-shaped element such as element 31 shown in FIG. 5 is obtained. It will be appreciated that this manufacturing method can be subject to various modifications and that, in particular, one can provide a combined differential operation of these central and surrounding punches. One can also provide the use of intermediary punches having successive increasing sizes.

On the other hand, for facilitating the sliding of the sheets which takes place during the forming operation, one can provide during the manufacturing of the magnetic equal sheet tore 43, to arrange a lubricating element between each winding. This lubricating agent can be for example grease, oil, talc or any other known lubricating means. It should be noted that, during the forming steps, sliding must be allowed on the contact area between the elements 44 and the surrounding punch 42. This sliding can be made easier by providing the contact area of the punch 42 with ball-bearing or roller-bearing, or with any known lubricating means.

Figure 7:
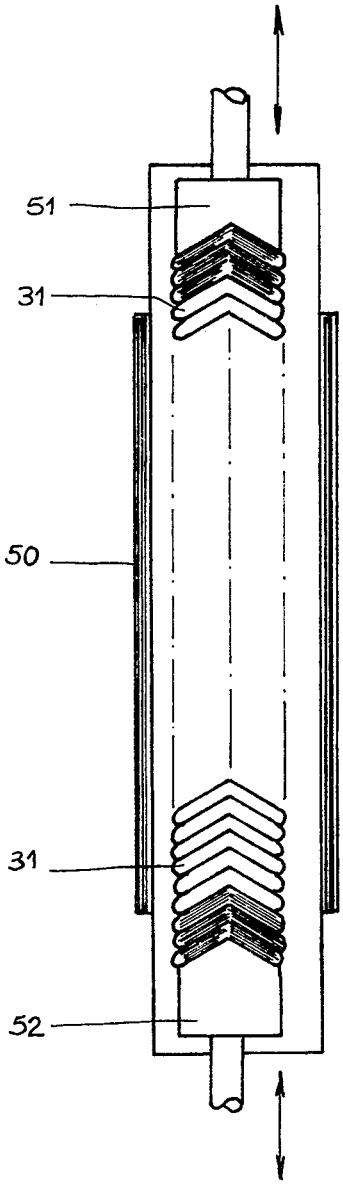
FIG. 7 shows a baking method for the V-shaped elements according to FIG. 5 and, FIGS. 8A and 8B are front view and side view respectively of an embodiment of a three-phase transformer according to the invention.

FIG. 7 shows a preferred method for baking the V-shaped elements 31 according to the invention. Those elements 31 are positioned in a baking oven 50 between two pressing means, a concave pressing means 51 and a convex pressing means 52 which insure their tightening. Those pressing means are movable in the direction of the shown arrows in order to permit the loading and the unloading of the V-shaped elments before and after the baking respectively at the ends of the oven. According to the well-known methods, it is possible to provide automatic loading and unloading and an incremented advance of the elements 31 for insuring a baking during a determined period of time. It will be noted that it is of course possible to insert between each of the V-shaped magnetic elements spacers having the same shape, those spacers can also be provided every 2, 3, 4, etc elements.

Figure 8B:
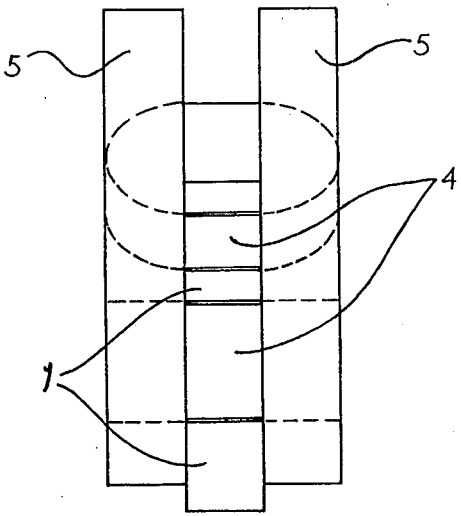
Figure 8A:
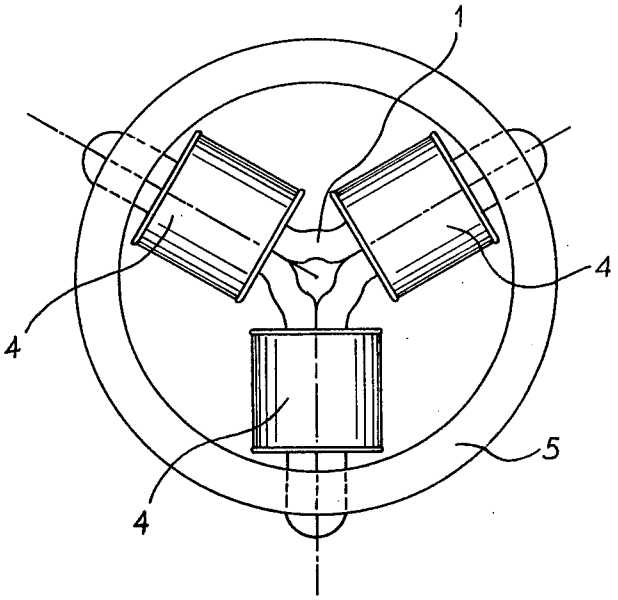

FIGS. 8A and 8B are respectively schematic front and side views of a three-phase transformer using a star magnetic circuit element according to the invention. In those figures, a star according to FIG. 2 is shown, but it will be apparent that any other star disclosed herein can be used. In this three-phase tranformer, coils 4 are arranged at each leg of the star, then yokes 5 are arranged on both sides of the star for closing the magnetic circuit. The contact area between the yokes 5 and the star is greater or equal to the half cross-section of a leg of the star. Accordingly, the reluctance of the gaps and yokes is substantially decreased. Such a transformer can comprise simple securing means and, as the surface of the gaps between the yokes and the star is large, it is not necessary to provide a surfacing or a grinding of the contact areas. However, such a surfacing or grinding may be provided if necessary for specific applications. The association of the star 1 and of the two tore-shaped yokes 5 provides a very rigid mechanical structure and the outer gaps are very efficiently tightened by the effect of the tightening means. This arrangement of a three-phase transformer presents in particular the advantage to reduce the length of the flux lines and the bulk of the whole transformer for a given power, due to the absence of the gap at the center part of the star. Such a device will provide a better efficiency, a lower no-load current, a lower magnetic material weight and a lower electric material weight, this latter characteristic being mainly due to the fact that, in view of the very efficient tightening of the gaps, it is possible to operate at a very high induction value in the magnetic circuit for example in the range of 1.8 to 2.0 Tesla and to increase accordingly the current density in the electric coils. Tapered coils permit to reduce the transformer size to a minimum. It will also be noted that the transformer shown in FIGS. 8A and 8B constitutes only a particular example of application of a star according to the present invention, such a magnetic circuit element being possibly used in many other devices, for examples a six-phase power transformer can be obtained by means of a six-legs star, a four-phase power transformer by means of a four-legs star. It is also possible to provide phase number transformers such as transformers from three-phase current to six-phase current or from two-phase current to four-phase current, etc... Also a transformer according to the invention can be used for measuring and controlling the current balance of a polyphase mains. Also, the closing yokes 5 have been disclosed hereover as being tore-shaped, it is clear that those yokes can have any other shape, such as polygonal, in case of specific applications.

Although the device comprising the star magnetic circuit, the closing yokes and the associated electrical coils has been considered as a transformer, it is apparent that according to the nature of the electrical coils and to the electrical connections, this device can be a polyphased transformer or a polyphased coil circuit.

In the invention, the star-shape will be understood in a general meaning. In particular, the star is not necessarily regularly shaped.

The present embodiments are to be considered in all respects as illustrative and not restrictive, the scope and principle of the invention being indicated by the claims rather than by the foregoing description, and all changes which come within the meaning and range of equivalents of the claims are therefore intended to be embraced therein.

I claim:

1. A method for manufacturing a V-shaped magnetic circuit element comprising the following steps:

manufacturing a wound magnetic tore, positioning said tore in a stamping die having a portion with a V-shape according to a determined angle, punching said tore against the V-shaped portion of the stamping die to flatten the tore fully against itself into said V-shape by successively operating punches of successively increasing sizes, the first of said punches being operated to press the tore toward only the neighborhood of the central area of said V-shaped portion and the last of said punches being operated to press the resulting extremities of the tore against the outer extremities of said V-shaped portion.

2. A manufacturing method according to claim 1, further comprising the step of manufacturing said tore of magnetic sheet and providing the magnetic sheet with a lubricating means before winding same into said tore.

3. A manufacturing method according to claim 2, wherein the punches for punching the tore are provided with sliding means or lubricating means on their surface in contact with said tore.

4. A manufacturing method according to claim 1, further comprising the step of baking the V-shaped elements, in an oven, those elements being arranged one against the other and pressed in order to avoid their deformation.

5. A manufacturing method according to claim 4, including automatically and sequentially loading and unloading said oven.

6. In the method of manufacturing a V-shaped magnetic circuit core element for an electrical transformer from a laminated magnetic tore, the improvement comprising the steps of:

positioning said tore in a V-shaped die, and pressing said tore fully flat against itself into said V-shape by punching said tore against said V-shaped die with successive punches of successively increasing areas starting in the neighborhood of the central area of said V-shaped die and progressing outwardly therefrom.

7. A method as in claim 6 including providing lubrication in said tore for allowing sliding of the tore laminations during the said pressing of said tore.

* * * * *